US006389853B1

(12) United States Patent
Pate et al.

(10) Patent No.: US 6,389,853 B1
(45) Date of Patent: May 21, 2002

(54) APPARATUS AND METHOD FOR DETERRING THE THEFT OF A COMPUTER

(75) Inventors: John C. Pate, Windsor (GB); Andrew Moore, Austin, TX (US)

(73) Assignee: Dell USA, L.P., Round Rock, TX (US)

( * ) Notice: Subject to any disclaimer, the term of this patent is extended or adjusted under 35 U.S.C. 154(b) by 0 days.

(21) Appl. No.: 09/482,596

(22) Filed: Jan. 13, 2000

(51) Int. Cl.[7] ..... E05B 73/00

(52) U.S. Cl. ..... 70/18; 70/53; 70/58; 70/DIG. 49; 340/432; 340/568.2; 340/572.9; 439/304

(58) Field of Search ..... 70/58, 53, DIG. 49, 70/18, 57, DIG. 30; 340/432, 568.2, 568.4, 572.9, 555; 439/304, 305; 200/43.22

(56) References Cited

U.S. PATENT DOCUMENTS

| | | | | | |
|---|---|---|---|---|---|
| 3,596,265 | A | * | 7/1971 | Garland | 340/568.2 |
| 3,824,540 | A | * | 7/1974 | Smith, II | 340/63 |
| 4,211,995 | A | * | 7/1980 | Smith | 340/63 |
| 4,663,611 | A | * | 5/1987 | Humphrey | 340/542 |
| 4,698,620 | A | * | 10/1987 | Marshall | 340/568 |
| 4,875,350 | A | * | 10/1989 | Faust | 70/241 |
| 4,896,140 | A | * | 1/1990 | Biever et al. | 340/568.2 |
| 4,935,725 | A | | 6/1990 | Turnau | 340/568 |
| 4,992,789 | A | * | 2/1991 | Czerwinski | 340/568.2 X |
| 5,034,723 | A | * | 7/1991 | Maman | 340/568.2 |
| 5,142,269 | A | | 8/1992 | Mueller | 340/568 |
| 5,172,098 | A | | 12/1992 | Leyden et al. | 340/568 |
| 5,190,466 | A | * | 3/1993 | McVey | 70/58 X |
| 5,231,375 | A | | 7/1993 | Sanders et al. | 340/568 |
| 5,254,973 | A | | 10/1993 | Gilmore, II | 340/547 |
| 5,289,559 | A | * | 2/1994 | Wilson | 340/568.2 X |
| 5,381,685 | A | | 1/1995 | Carl et al. | 70/78 |
| 5,406,260 | A | | 4/1995 | Cummings et al. | 340/568 |
| 5,493,878 | A | | 2/1996 | Murray, Jr. et al. | 70/58 |
| 5,561,417 | A | * | 10/1996 | Rothbaum et al. | 340/568.2 |
| 5,570,080 | A | * | 10/1996 | Inoue et al. | 340/571 |
| 5,617,073 | A | * | 4/1997 | Wilson | 340/568.2 |
| 5,675,321 | A | | 10/1997 | McBride | 340/568 |
| 5,692,400 | A | | 12/1997 | Bliven et al. | 70/58 |
| 5,727,405 | A | * | 3/1998 | Cromwell | 70/53 X |
| 5,787,738 | A | | 8/1998 | Brandt et al. | 70/58 |
| 5,912,623 | A | * | 6/1999 | Pierson | 340/573.4 |
| 5,960,651 | A | * | 10/1999 | Tanisawa | 340/568.2 X |
| 6,037,867 | A | * | 3/2000 | Joseph et al. | 340/508 |
| 6,087,939 | A | * | 7/2000 | Leyden et al. | 340/568.2 |
| 6,100,802 | A | * | 8/2000 | Adams | 340/542 |

* cited by examiner

*Primary Examiner*—Lloyd A. Gall
(74) *Attorney, Agent, or Firm*—Haynes and Boone, LLP

(57) ABSTRACT

An apparatus for deterring theft of an electronic device, includes a lock having a housing and a retention member movably mounted in the housing for being moved between a locked position and an unlocked position. An elongated retaining member has a first end connected to the lock, and a second end connected to an anchoring member. A plurality of contacts are attached to the lock. A first one of the contacts is electrically isolated from a second one of the contacts. A continuity detection element is attached to the retaining member for detecting a discontinuity between the first and the second ends of the retaining member. The continuity detection element is electrically connected to the first and the second contacts.

21 Claims, 4 Drawing Sheets

APPARATUS AND METHOD FOR DETERRING THE THEFT OF A COMPUTER

BACKGROUND

The disclosures herein relate generally to computers and more particularly to an apparatus and a method for deterring the theft of a computer.

With desktop and portable computers becoming more powerful, they are increasingly running more complex and critical tasks. These tasks often include archiving, computing and analyzing confidential and proprietary information. In the case of portable personal computers, the portability of these types of computers further adds to their utility by allowing the user to readily transport the computer to different locations.

Computers of all types are subject to theft. Protecting computers is essential due to the expense associated with replacing them. Equally important, if not more important, is the need to protect any confidential information stored on the computer. Due to their portability, portable personal computers are particularly susceptible to theft. A study conducted by Rand Corporation in March of 1999 claims that US corporations lose more than $4 billion a year in electronic thefts. Personal computers make up a considerable portion of this stolen electronic equipment.

U.S. Pat. No. 5,787,738 discloses a security device for a portable computer having a display that can be locked in the closed position to prevent the computer from being removed from a given location. The security device includes a blade member that can freely pass through a gap between a display and a keyboard of the portable computer. Attached to one end of the blade member is a blocking member which is larger than the gap. The other end of the blade member is attached or otherwise fastened to a fixed object. The blocking member is placed adjacent the display screen prior to closing and locking the display to deter unauthorized transport of the portable computer.

U.S. Pat. No. 5,493,878 discloses an apparatus which provides a deterrent against the theft of equipment such as a personal computer. The equipment must have an external wall provided with a specially designed, approximately rectangular slot having preselected dimensions. An attachment mechanism includes a housing for a spindle, a shaft extending outwardly from the housing, and a crossmember at the end of the shaft. An abutment mechanism also extends from the housing and is located on opposite sides of the shaft intermediate the housing and the crossmember. The crossmember is aligned with the abutment mechanism so that the crossmember can be inserted through the slot with the shaft and the abutment mechanism occupying the slot. The spindle is then rotated 90° to misalign the crossmember with the slot, thereby attaching the attachment mechanism rigidly to the external wall. A cable is secured to the housing and to an immovable object.

U.S. Pat. No. 5,142,269 discloses an anti-theft system for electronic devices with conventional data port connectors. The system includes a single sensor or a plurality of interconnected sensors. Each sensor includes a housing and a pair of interconnected conventional data connectors for being connected to the data port connectors of the electronic device. Switching means associated with each data connector and alarm circuitry are provided. When the system is in the active state, an alarm sounds if any of the data connectors are disconnected from the electronic device or if the interconnect between two connectors is otherwise breached.

Presently, most personal computers include a rectangular-shaped lock hole that allows a theft deterrent device to be attached. The lock hole provided in many brands of computers is configured to receive a standardized lock such as a Kensington-type lock. Kensington-type locks have a retention member including a generally rectangular-shaped cross bar for engaging the lock hole of the computer to secure the theft deterrent device to the computer. A typical theft deterrent device includes a lock for being attached to the lock hole and a cable attached to the lock for being secured to a remote article that is immovable or difficult to move.

The attachment of a conventional theft deterrent device does well at preventing theft by the 'opportunist-type' of thief. Most of these types of thieves are not equipped with the required tools to readily defeat a conventional theft deterrent device. However, a more determined and prepared thief can easily cut the cable of a conventional theft deterrent device, allowing the computer to be removed from the premises.

Accordingly, there is a need for an improved apparatus and method for initiating a security measure by a detection apparatus mounted within an electronic device when an unauthorized detachment of a security apparatus from the electronic device is detected.

SUMMARY

One embodiment, accordingly, provides a security apparatus for physically securing the computer to a substantially immovable object and for enabling a detection apparatus to initiate a security measure if the security apparatus is removed from the computer without authorization or if a continuity detection element of the security apparatus is severed. To this end, an apparatus for deterring theft of an electronic device includes a lock having a housing and a retention member movably mounted in the housing for being moved between a locked position and an unlocked position with respect to the housing. An elongated retaining member is attached at a first end to the lock. The retaining member includes an anchoring member attached to a second end thereof. A plurality of contacts are attached to the lock. A first one of the contacts is electrically isolated from a second one of the contacts. A continuity detection element is attached between the first and the second ends of the retaining member for detecting a discontinuity between the first and the second ends of the retaining member. The continuity detection element is electrically connected to the first and the second contacts.

A principal advantage of this embodiment is that the security apparatus enables the electronic device to initiate a security measure when unauthorized removal or severing of the retaining member is detected by the continuity detection apparatus.

BRIEF DESCRIPTION OF THE DRAWING FIGURES

DETAILED DESCRIPTION

Figure 1:
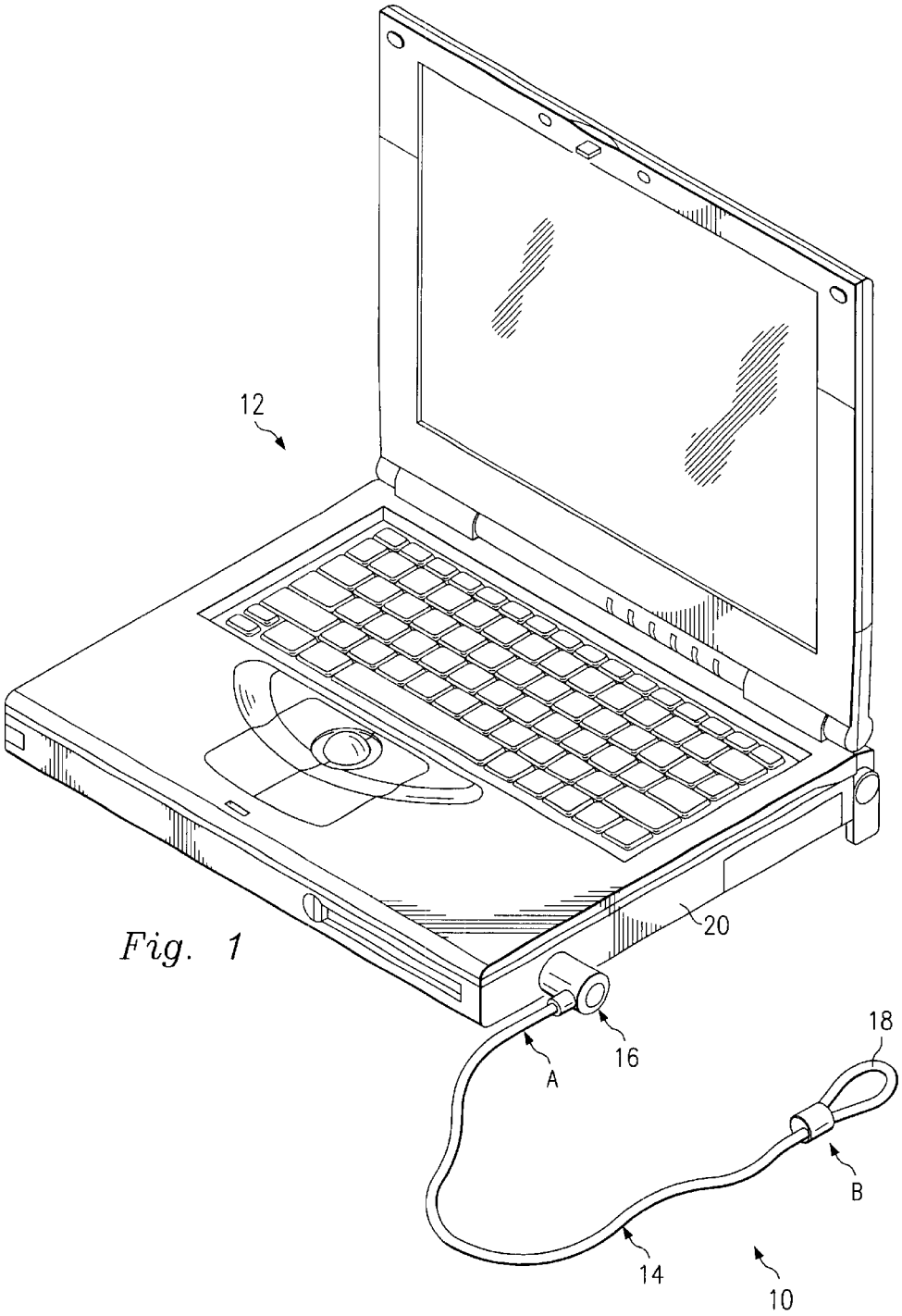
FIG. 1 is a perspective view illustrating an embodiment of a security apparatus connected to an electronic device.

An embodiment of a security apparatus 10 attached to an electronic device 12 such as a portable computer is illustrated in FIG. 1. The security apparatus 10 includes a retaining member 14 having a lock portion 16 attached at a first end A and an anchor member 18 attached at a second end B. The lock portion 16 is removably attached to an enclosure 20 of the electronic device 12. The anchor member 18 may be attached to a substantially immovable object such as a desk or wall to deter unauthorized transport of the computer 12.

Figure 2:
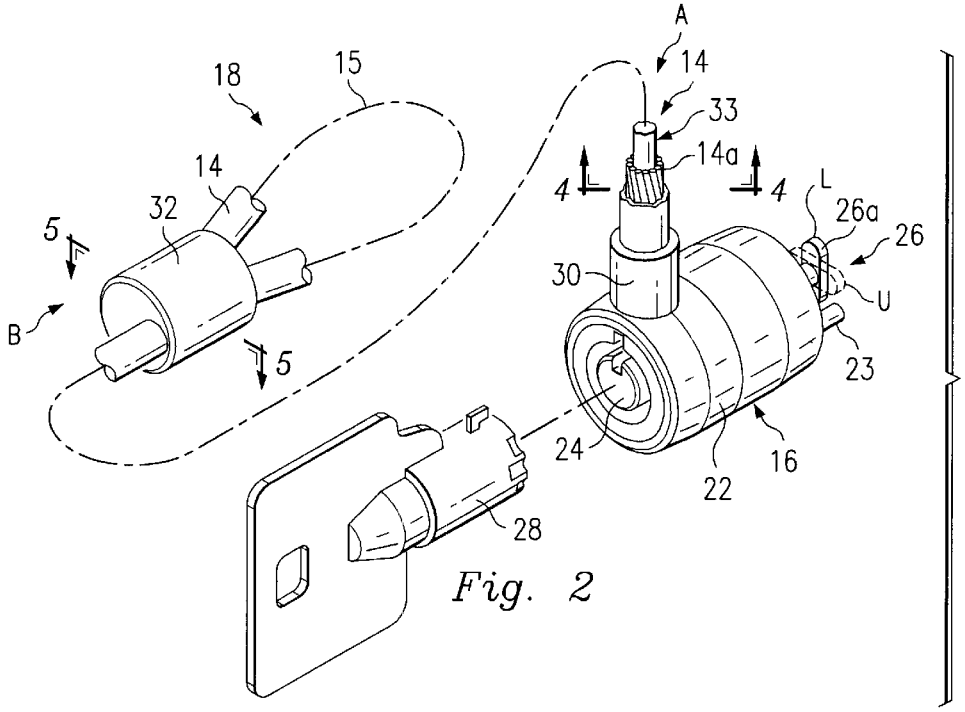
FIG. 2 is a fragmentary perspective view illustrating an embodiment of a security apparatus.
Figure 3:
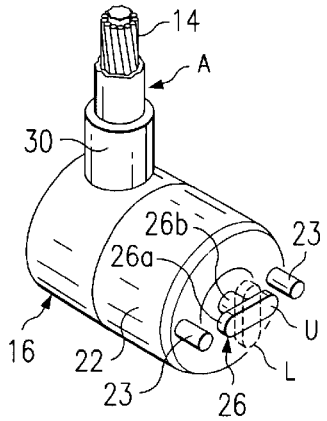
FIG. 3 is a perspective view illustrating an embodiment of a lock portion of the security apparatus.

Referring now to FIGS. 2 and 3, the lock portion 16 includes a lock body 22, a plurality of positioning members 23 attached to the lock body 22, a key mechanism 24, FIG. 2, pivotally mounted in the lock body 22 and retention member 26 pivotally mounted in the lock body 22. The positioning members 23 may be integrally formed with the lock body 22. The key mechanism 24 is attached to the retention member 26 within the lock body 22, as discussed below in greater detail.

A key 28, FIG. 2, mates with a corresponding portion of the key mechanism 24 for moving a crossbar portion 26*a* of the retention member 26 between a locked position L and an unlocked position U with respect to the lock body 22. The lock position L is approximately 90 degrees from the unlocked position U. The retaining member 14 is attached at the first end A to a mounting boss portion 30 of the lock body 22. The anchor member 18, FIG. 2, is formed at the second end B of the retaining member 14 using a collar 32 to provide a loop portion 15 in the retaining member 14. The collar 32 may be made of a conductive material such as steel and a non-conductive material such as plastic.

Figure 4:
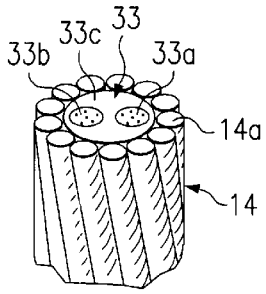
FIG. 4 is a cross sectional view taken along the line 4—4 in FIG. 2.
Figure 5:
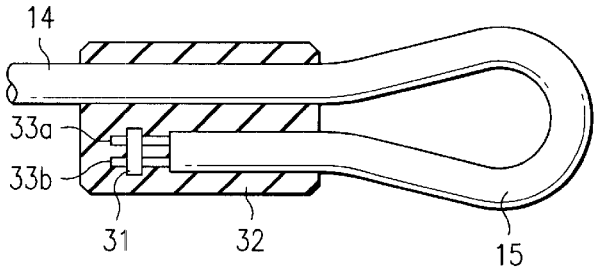
FIG. 5 is cross sectional view taken along the line 5—5 in FIG. 2.

In one embodiment, FIGS. 2 and 4, a continuity detection element such as a wire 33 is embedded in the retaining member 14. The retaining member 14 includes a cable portion 14*a* made of metal strands with the wire 33, FIG. 4, extending between the first and second ends A, B, FIG. 2, of the retaining member 14. The wire 33, FIG. 4, includes a first conductor 33*a*, a second conductor 33*b* and an insulating layer 33*c* for electrically isolating the conductors 33*a*, 33*b* from each other and at least one of the conductors 33*a*, 33*b* from the retaining member 14. The conductors 33*a*, 33*b* are electrically connected to each other in the collar 32, FIG. 5, by a connector 31.

Figure 6:
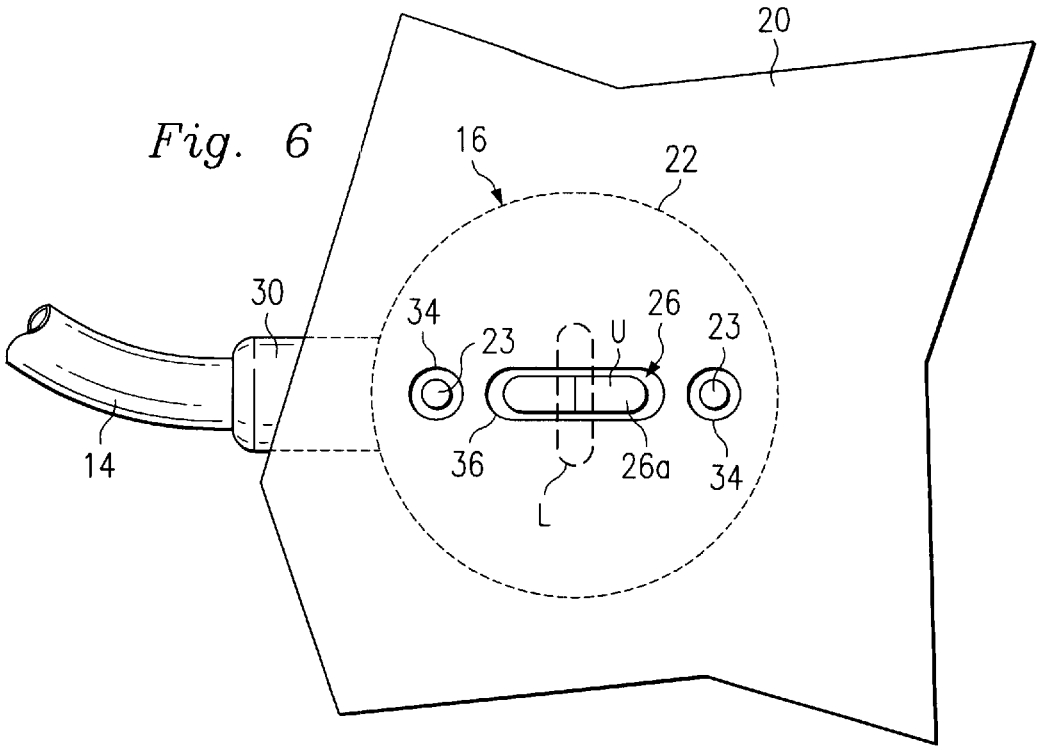
FIG. 6 is a diagrammatic view illustrating an embodiment of the lock portion of the security apparatus attached to an enclosure.

As illustrated in FIG. 6, the positioning members 23 engage corresponding positioning holes 34 in the enclosure 20 to limit rotation of the lock body 22 with respect to the enclosure 20 and to position the crossbar portion 26*a* of the retention member 26 with respect to the slot 36 in the enclosure 20. The crossbar portion 26*a* and the slot 36 are oblong-shaped with the size of the slot 36 being slightly larger than the crossbar portion 26*a*. The enclosure 20 will typically be made of metal, plastic or a combination thereof. With the positioning members 23 aligned with the corresponding positioning holes 34 and the retention member 26 in the unlocked position U, crossbar portion 26*a* of the retention member 26 may be inserted into the enclosure 20 through the slot 36. Once inserted into the slot 36, the retention member 26 may be moved to the locked position L to misalign the crossbar portion 26*a* of the retention member 26, securing the lock portion 16 to the enclosure 20.

Figure 7:
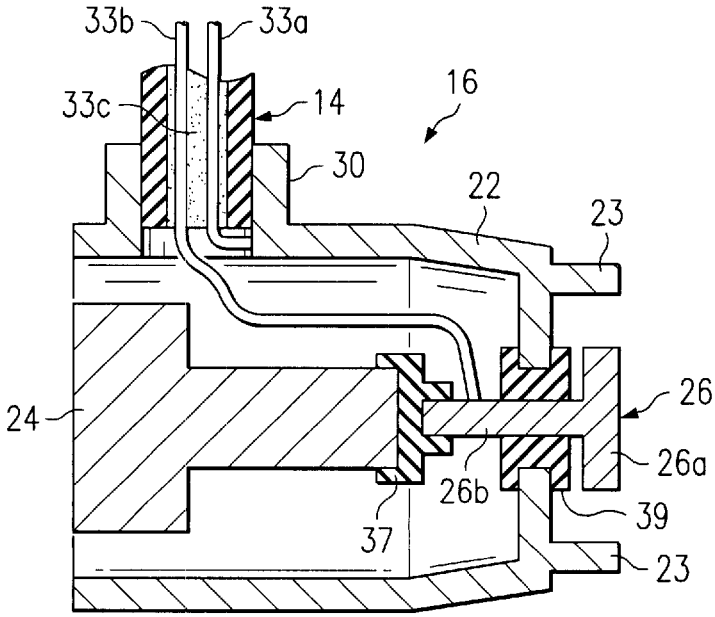
FIG. 7 is a cross sectional view illustrating an embodiment of electrical connections in the lock portion of the security apparatus.

An embodiment of a lock portion 16 is illustrated in FIG. 7. The lock body 22 and the retention member 26 are made of an electrically conductive material such as steel or aluminum. The retention member 26 includes a shaft portion 26*b* that extends axially between the crossbar portion 26*a* of the retention member 26 and a first sleeve 37. The first sleeve 37 is mounted between the key mechanism 24 and the shaft portion 26*b* of the retention member 26 for permitting the crossbar portion 26*a* of the retention member 26 to be moved between the locked position L and the unlocked position U by movement of the key mechanism 24.

The first conductor 33*a*, FIG. 7, is attached the lock body 22 and the second conductor 33*b* is attached to the shaft portion 26*b* of the retention member 26. The first sleeve 37 is made of a non-conductive material for electrically isolating the retention member 26 from the key mechanism 24. A second sleeve 39 is mounted between the shaft portion 26*b* of the retention member 26 and the lock body 22. The second sleeve 39 is made of a non-conductive material for electrically isolating the retention member 26 from the lock body 22.

Figure 8:
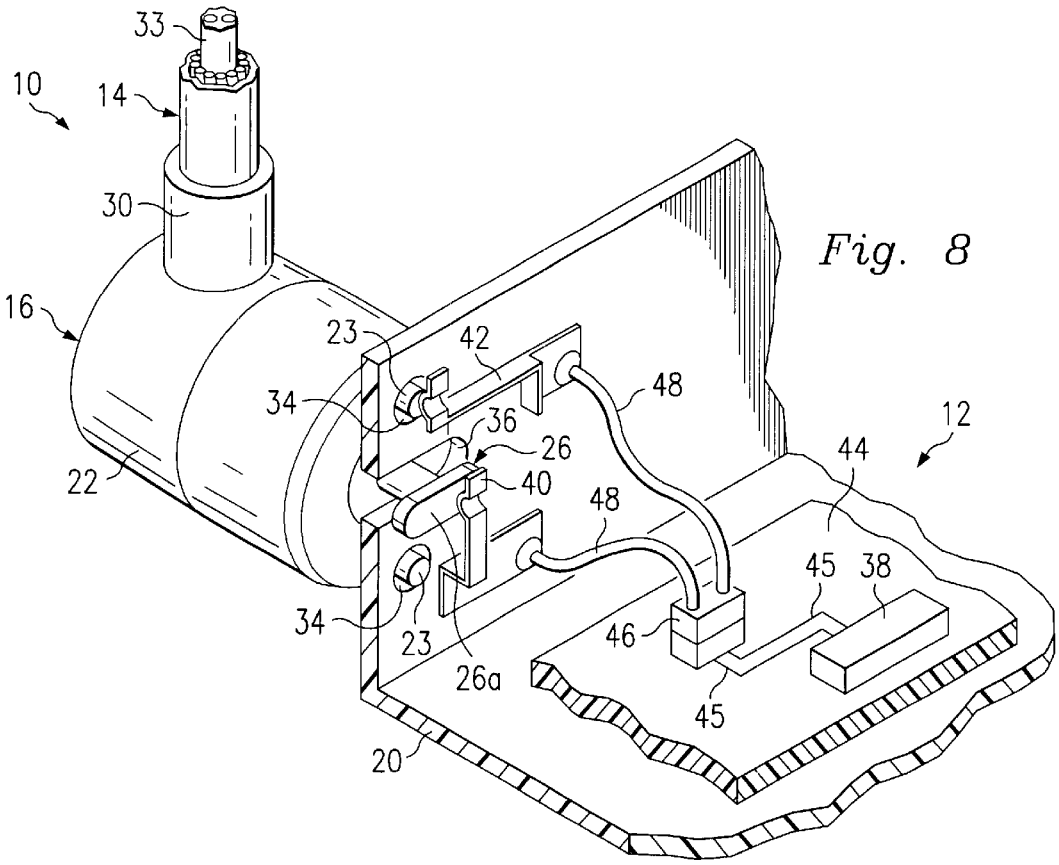
FIG. 8 is a diagrammatic view illustrating an embodiment of electrical connections between the security apparatus and a continuity detection apparatus.

FIG. 8 illustrates an embodiment of a structure for electrically connecting the security apparatus 10 to a continuity detection apparatus 38. The continuity detection apparatus 38 allows one or more security measures to be initiated in response to unauthorized detachment of the security apparatus 10 or a break in the continuity of the wire 33 being detected. The continuity detection apparatus 38 may be mounted in the enclosure 20 of the electronic device 12. The crossbar portion 26*a* of the retention member 26 defines a first electrical contact that engages a first contact terminal 40 when inserted into the slot 36. At least one of the positioning members 23 defines a second electrical contact that engages a second contact terminal 42 to electrically connect the lock body 22 with the continuity detection apparatus 38. The first and the second contact terminals 40, 42 are electrically isolated from each other with respect to electrical continuity through the enclosure 20. In this manner, electrical continuity may be established through the wire 33.

The continuity detection apparatus 38, FIG. 8, is mounted in the enclosure 20 with at least a portion of the continuity detection apparatus 38 being attached to a motherboard 44. The continuity detection apparatus 38 is electrically connected to the contact terminals 40, 42 through a plurality of conductive traces 45 formed in the motherboard 44. A connector assembly 46 is electrically connected to the traces 45 and a plurality of leads 48 are electrically connected between the connector assembly 46 and the contact terminals 40, 42.

Figure 9:
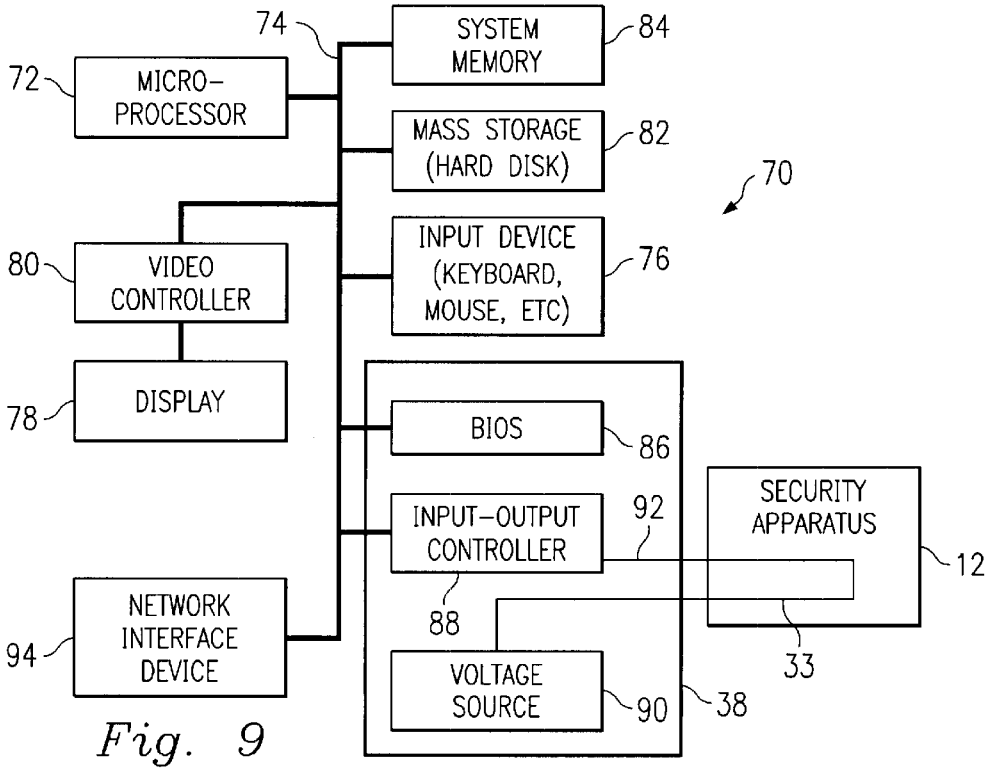
FIG. 9 is a block diagram illustrating an embodiment of the security apparatus attached to a computer system.

An embodiment of a computer system 70 is illustrated in FIG. 9. The computer system 70 includes at least one microprocessor 72. The microprocessor 72 is connected to a signal bus 74. The signal bus 74 serves as a connection between the microprocessor 72 and other components of the computer system 70. One or more input devices 76 may be coupled to the microprocessor 72 to provide input to the microprocessor 72. Examples of input devices include keyboards, touchscreens, and pointing devices such as a mouse, a trackball and a trackpad. The computer system 70 may also include a display 78 which is typically coupled to the microprocessor 72 by a video controller 80. Programs and data are stored on a mass storage device 82 which is coupled to the microprocessor 72. Mass storage devices include components such as hard disks, optical disks, magneto-optical drives, floppy drives, and the like. A system memory 84 is coupled to the microprocessor 72 for providing the microprocessor 72 with fast storage to facilitate execution of computer programs by the microprocessor 72. A basic input-output system (BIOS) 86 and an input-output controller 88 are also coupled to the signal bus 74 for communicating with each other and with the microprocessor 72. It should be understood that other busses and intermediate circuits can be employed between the components described above and microprocessor 72 to facilitate interconnection between the components and the microprocessor 72.

Still referring to FIG. 9, in one embodiment, the continuity detection apparatus 38 includes the BIOS 86, the input-output controller 88 and a reference voltage source 90. The wire 33 of the security apparatus 10, see also FIG. 1, is coupled between the input-output controller 88 and the reference voltage source 90. The reference voltage source 90 is maintained at a first reference voltage. The wire 33 is connected to a General Purpose Input Output (GPIO) signal line 92 of the input output controller 88. The GPIO signal line 92 is normally at a second reference voltage when not connected to the security apparatus 10 and is maintained at the first reference -voltage when wire 33 of the security apparatus 10 is connected between the GPIO signal line 92 and the reference voltage source 90. When the security apparatus 10 is removed from the housing 20 or when continuity of the wire 33 is broken, such as by cutting the retaining member 14, the voltage of the GPIO signal line 92 change from the first reference voltage to the second reference voltage. When the GPIO signal line 92 is polled by the BIOS 86, the BIOS 86 may initiate one or more security measures in response to the security apparatus 10 being removed or electrical continuity through the wire 33 being broken. These security measures include activating an alarm, sending a message to a system administrator through a network interface device 94 such as a network interface card, and disabling all or part of the functionality of the computer system 70.

One embodiment provides an apparatus for deterring theft of an electronic device including a lock having a housing and a retention member movably mounted in the housing for being moved between a locked position and an unlocked position with respect to the housing. An elongated retaining member is attached at a first end to the lock. The retaining member includes an anchoring member attached to a second end thereof. A plurality of contacts are attached to the lock. A first one of the contacts is electrically isolated from a second one of the contacts. A continuity detection element is attached between the first and the second ends of the retaining member for detecting a discontinuity between the first and the second ends of the retaining member. The continuity detection element is electrically connected to the first and the second contacts.

Another embodiment provides a computer security system including an enclosure for mounting a plurality of computer system components therein. The enclosure includes a lock attachment member. A lock attachable to the lock attachment member of the enclosure is provided. The lock includes a housing and a retention member movably mounted in the housing for being moved between a locked position and an unlocked position with respect to the housing. An elongated retaining member is attached at a first end thereof to the lock. The retaining member includes an anchoring member attached to a second end thereof. A plurality of contacts are attached to the lock. A first one of the contacts is electrically isolated from a second one of the contacts. A continuity detection element extends between the first and the second ends of the retaining member for detecting a discontinuity between the first and the second ends of the retaining member. The continuity detection element is electrically connected to the first and the second contacts. A plurality of contact terminals are mounted in the enclosure. The first and the second contacts are electrically connected to first and second respective contact terminals when the lock is attached to the lock attachment member of the enclosure.

In yet a further embodiment, an apparatus for deterring theft of a computer includes a lock having a housing and a retention member movably mounted in the housing for being moved between a locked position and an unlocked position with respect to the housing. An elongated retaining member is attached at a first end thereof to the lock. The retaining member includes an anchoring member attached to a second end thereof. A plurality of contacts are attached to the lock. A first one of the contacts is electrically isolated from a second one of the contacts. A device for detecting a discontinuity between the first and the second ends of the retaining member is provided. The device for detecting the discontinuity is electrically connected to the first and the second contacts.

In still another embodiment, a method for deterring theft of a computer includes attaching a lock portion to a first end of a retaining member and attaching an anchor member to the second end of the retaining member. A continuity detection member is attached to the retaining member between the first end and the second end of the retaining member and the lock portion is attached to an enclosure of a computer. The continuity detection element is electrically connected to a continuity detector device for establishing a closed circuit between the continuity detection element and the continuity detector device. The continuity detector device enables a security measure for deterring theft of the computer to be initiated when the continuity detector device detects an open circuit between the continuity detection element and the continuity detector device.

As it can be seen, the embodiments presented herein provide several advantages. The security apparatus provides physical restraint of the electronic device. The security apparatus also enables the electronic device to initiate a security measure when unauthorized removal or severing of the retaining member is detected by the continuity detector device. The retaining member and the continuity detection element are jointly constructed in a manner which makes severing the retaining member separately from the continuity detection element extremely difficult and time consuming. The lock portion of the security apparatus mates with a standardized lock attachment member of the electronic device. The security apparatus may be cost effectively manufactured.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. An apparatus for deterring theft of an electronic device, comprising:

a lock including a housing and a retention member movably mounted in the housing for being moved between a locked position and an unlocked position;

an elongated retaining member attached at a first end thereof to the lock, the retaining member including an anchoring member attached to a second end thereof;

a plurality of contacts attached to the lock, a first one of the contacts being the movable retention member electrically isolated from a second stationary one of the contacts;

a continuity detection element mounted in the retaining member for detecting a discontinuity between the first and the second ends of the retaining member; and a continuity detection device mounted in the electronic device and connected to the continuity detection element by the first and second contacts in response to the retention member being moved to the locked position.

2. The apparatus of claim 1 wherein the continuity detection element includes a wire extending at least partially between the first and the second ends of the retaining member.

3. The apparatus of claim 2 wherein the retaining member is a cable including a plurality of twisted strands of metal.

4. The apparatus of claim 3 wherein the wire is embedded within at least a portion of the twisted strands of metal.

5. The apparatus of claim 2 wherein the wire is an insulated wire.

6. The apparatus of claim 2 wherein the first contact is electrically connected to a first end of the wire and the second contact is electrically connected to a second end of the wire.

7. The apparatus of claim 1 further comprising an electrical insulator attached between the retention member and the housing.

8. The apparatus of claim 1 wherein the continuity detection element includes a plurality of wires extending at least partially between the first and second ends of the retaining member, at least two of the wires being electrically connected to each other adjacent to the second end of the retaining member.

9. The apparatus of claim 1 further comprising an enclosure including a lock attachment member attached thereto and wherein the lock attachment member includes an opening for receiving a portion of the retention member.

10. The apparatus of claim 9 wherein the enclosure includes a chassis, the lock attachment member being attached to the chassis.

11. A computer security system, comprising:

an enclosure for mounting a plurality of computer system components therein, the enclosure including a lock attachment member attached thereto;

a lock attachable to the lock attachment member of the enclosure, the lock including a housing and a retention member movably mounted in the housing for being moved between a locked position and an unlocked position;

an elongated retaining member attached at a first end thereof to the lock, the retaining member including an anchoring member attached to a second end thereof;

a plurality of contacts attached to the lock, a first one of the contacts being the movable retention member electrically isolated from a second stationary one of the contacts;

a continuity detection element mounted in the retaining member for detecting a discontinuity between the first and the second ends of the retaining member;

a plurality of contact terminals mounted in the enclosure, the first and the second contacts being electrically connected to a first and a second respective contact terminal when the lock is attached to the lock attachment member of the enclosure; and a continuity detector device mounted in the enclosure and connected to the continuity detection element by the first and second contacts in response to the retention member being moved to the locked position.

12. The system of claim 11 wherein the continuity detection element includes a wire extending at least partially between the first and the second ends of the retaining member.

13. The system of claim 12 wherein the retaining member is a cable including a plurality of twisted strands of metal.

14. The system of claim 13 wherein the wire is embedded within at least a portion of the twisted strands of metal.

15. The system of claim 12 wherein the wire is an insulated wire.

16. The system of claim 12 wherein the first contact is electrically connected to a first end of the wire and the second contact is electrically connected to a second end of the wire.

17. The system of claim 11 further comprising an electrical insulator attached between the retention member and the housing.

18. The system of claim 11 wherein the retention member engages the lock attachment member when the lock is attached to the lock attachment member with the retention member in the locked position.

19. The system of claim 18 wherein the enclosure includes a chassis, the lock attachment member being attached to the chassis.

20. The system of claim 11 wherein the continuity detection element includes a plurality of wires extending at least partially between the first and second ends of the retaining member, at least two of the wires being electrically connected to each other adjacent to the second end of the retaining member.

21. An information handling system comprising:

a chassis;

a microprocessor mounted in the chassis;

a storage coupled to the microprocessor;

a video controller coupled to the microprocessor;

a memory coupled to provide storage to facilitate execution of computer programs by the microprocessor;

a lock attachment member mounted in the chassis;

a lock attachable to the lock attachment member, the lock including a housing and a retention member movably mounted in the housing for being moved between a locked position and an unlocked position;

an elongated retaining member attached at a first end thereof to the lock, the retaining member including an anchoring member attached to a second end thereof;

a plurality of contacts attached to the lock, a first one of the contacts being the movable retention member electrically isolated from a second stationary one of the contacts;

a continuity detection element mounted in the retaining member for detecting a discontinuity between the first and the second ends of the retaining member; and a continuity detection device mounted in the chassis and connected to the continuity detection element by the first and second contacts in response to the retention member being moved to the locked position.

* * * * *